US009326570B2

(12) United States Patent
Rydlewicz

(10) Patent No.: US 9,326,570 B2
(45) Date of Patent: May 3, 2016

(54) DECAGONAL SHAPED DIAMOND WHICH DISPLAYS HEARTS AND ARROWS PATTERN

(71) Applicant: Roni Rydlewicz, Brussels (BE)

(72) Inventor: Roni Rydlewicz, Brussels (BE)

(73) Assignee: WORLDWIDE DIAMOND TRADEMARKS LTD. (CA)

( * ) Notice: Subject to any disclaimer, the term of this patent is extended or adjusted under 35 U.S.C. 154(b) by 218 days.

(21) Appl. No.: 14/042,175

(22) Filed: Sep. 30, 2013

(65) Prior Publication Data

US 2014/0026616 A1 Jan. 30, 2014

Related U.S. Application Data

(63) Continuation-in-part of application No. 12/208,806, filed on Sep. 16, 2008, now abandoned.

(51) Int. Cl.
*A44C 17/00* (2006.01)

(52) U.S. Cl.
CPC ..... *A44C 17/001* (2013.01)

(58) Field of Classification Search
None
See application file for complete search history.

(56) References Cited

U.S. PATENT DOCUMENTS

| | | | | | |
|---|---|---|---|---|---|
| D416,511 | S | * | 11/1999 | Rams | D11/90 |
| D530,642 | S | * | 10/2006 | Botha | D11/90 |
| D550,118 | S | * | 9/2007 | Botha | D11/90 |
| D569,296 | S | * | 5/2008 | Voorn | D11/90 |
| 2007/0113586 | A1 | | 5/2007 | Rydlewicz | |
| 2008/0271486 | A1 | | 11/2008 | Rydlewicz | |

FOREIGN PATENT DOCUMENTS

CA 2 737 469 A1 3/2010

* cited by examiner

*Primary Examiner* — Jack W Lavinder
(74) *Attorney, Agent, or Firm* — Baker Hostetler LLP

(57) ABSTRACT

A decagonal shaped diamond, adapted to display a hearts and arrows pattern when exposed to light comparable to the hearts and arrows pattern in a round diamond. The decagonal shaped diamond should be cut to form ten main crown facets of substantially equal size symmetrically arranged relative to one another surrounding a table facet twenty star facets with two star facets polished on every main crown facet, ten main pavilion facets, an equal number of crown half facets as pavilion half facets, ten subsidiary pavilion half facets, twenty subsidiary pavilion facets and ten main girdle facets with the girdle facets polished at a given angle relative to one another for forming the decagonal shape of the diamond.

8 Claims, 6 Drawing Sheets

DECAGONAL SHAPED DIAMOND WHICH DISPLAYS HEARTS AND ARROWS PATTERN

The present invention is a continuation-in-part of U.S. patent application Ser. No. 12/208,806 filed Sep. 16, 2008 which, in turn, is a continuation-in-part of Ser. No. 11/744,571, the disclosure of each herein incorporated by reference, and relates to the field of cut diamonds and more particularly to a diamond having a decagonal shape adapted to generate a hearts and arrows pattern substantially comparable to the hearts and arrows pattern generated by an ideal round cut diamond when exposed to light.

FIELD OF THE INVENTION

Background of the Invention

A hearts and arrows pattern will be displayed by a round cut diamond when exposed to light when the round cut diamond has a nearly perfect symmetrical shape and possesses equal and symmetrically cut facets polished to within relatively narrow proportional ranges, as taught below in Table I. A near perfect round cut diamond having a hearts and arrows pattern provides brilliance, color and optical light handling properties which has not been matched in the marketplace by any other shaped diamond to date. Although diamonds are typically cut into many known geometrical shapes other than round such as, for example, a heart shape, oval, pear, marquis, princess, emerald, etc., it is currently unknown to cut a diamond into a decagonal shape which will yield a hearts and arrows pattern comparable to the hearts and arrows pattern generated by a round cut diamond of nearly perfect symmetrically round shape when exposed to light.

Heretofore, it was widely believed in the diamond industry that only the round cut diamond could generate a true hearts and arrows pattern. This belief was primarily based upon the fact that the round cut diamond has such a nearly perfect symmetrical shape and that all of its crown and pavilion facets can be readily cut to the same angle degrees with the angle differences between all of its pavilion angles being smaller than 0.3°, and with the angle tolerance between the main crown facets being smaller than 0.4° and the angle tolerance for the subsidiary crown facets being smaller than 0.3°. This led to the widely accepted belief within the diamond industry that it is only possible to obtain a true hearts and arrows pattern on a diamond polished to simulate the nearly perfect symmetrical shape of a round shaped diamond using the narrow angular tolerances known to yield a hearts and arrows pattern in a round cut diamond.

A decagonal shaped diamond has a geometrical shape which is dramatically different from that of a round diamond. Accordingly, if one accepts the widely accepted belief that only the round cut diamond can generate a true hearts and arrows pattern, it is inconceivable to polish the diamond into a decagonal shape which will yield a hearts and arrows pattern comparable to the hearts and arrows pattern in the round cut diamond.

In a round cut diamond, the hearts and arrows pattern appears only when the requirements for its cut facets, angle parameters and alignment relationships are as shown in the following Table 1:

TABLE 1

| |
|---|
| The shape of the diamond is perfectly symmetrical. |
| 8 main crown and 24 subsidiary crown facets. |
| 8 main bottom and 16 subsidiary bottom facets. |
| All main facets (crown & bottom) have to be polished at a perfect 45° angle to each other. |
| All facets are perfectly aligned. |

TABLE 1-continued

| | |
|---|---|
| All the bottom main facets are of equal size and at an angle ranging from 40.6°-41.0°. | |
| All the bottom subsidiary facets are of equal size and at an angle which is exactly 1.2° steeper than the main facets (main bottom angle 40.6°-41.0° + subsidiary 41.8°-42.2°). | |
| All the main crown facets are of equal size and at an angle ranging from 33.8°-35.1°. They have to be perfectly aligned on the main bottom facets. | |
| All the subsidiary crown facets are of equal size and perfectly aligned on the main crown and subsidiary bottom facets and polished at an equal angle. | |
| The ideal cut proportions are: | total depth 59.4%-62.4% crown height 14.5%-16.0%<br>girdle thickness 1.5%-2.95%<br>roundness 99.0%-100%<br>table size: 53.0%-57.5% |

SUMMARY OF THE INVENTION

The diamond of the present invention is cut into a decagonal shape adapted to display a hearts and arrows pattern substantially equivalent to the hearts and arrows pattern displayed in a round diamond when exposed to light. The decagonal cut diamond of the present invention comprises: ten main crown facets, ten main pavilion facets, twenty star facets with two star facets polished on every main crown facet, an equal number of crown half facets as pavilion half facets, ten subsidiary pavilion half facets, twenty subsidiary pavilion half facets and ten main girdle facets with the girdle facets polished at a given angle relative to one another for forming the decagonal shape of the diamond.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

Figure 1:
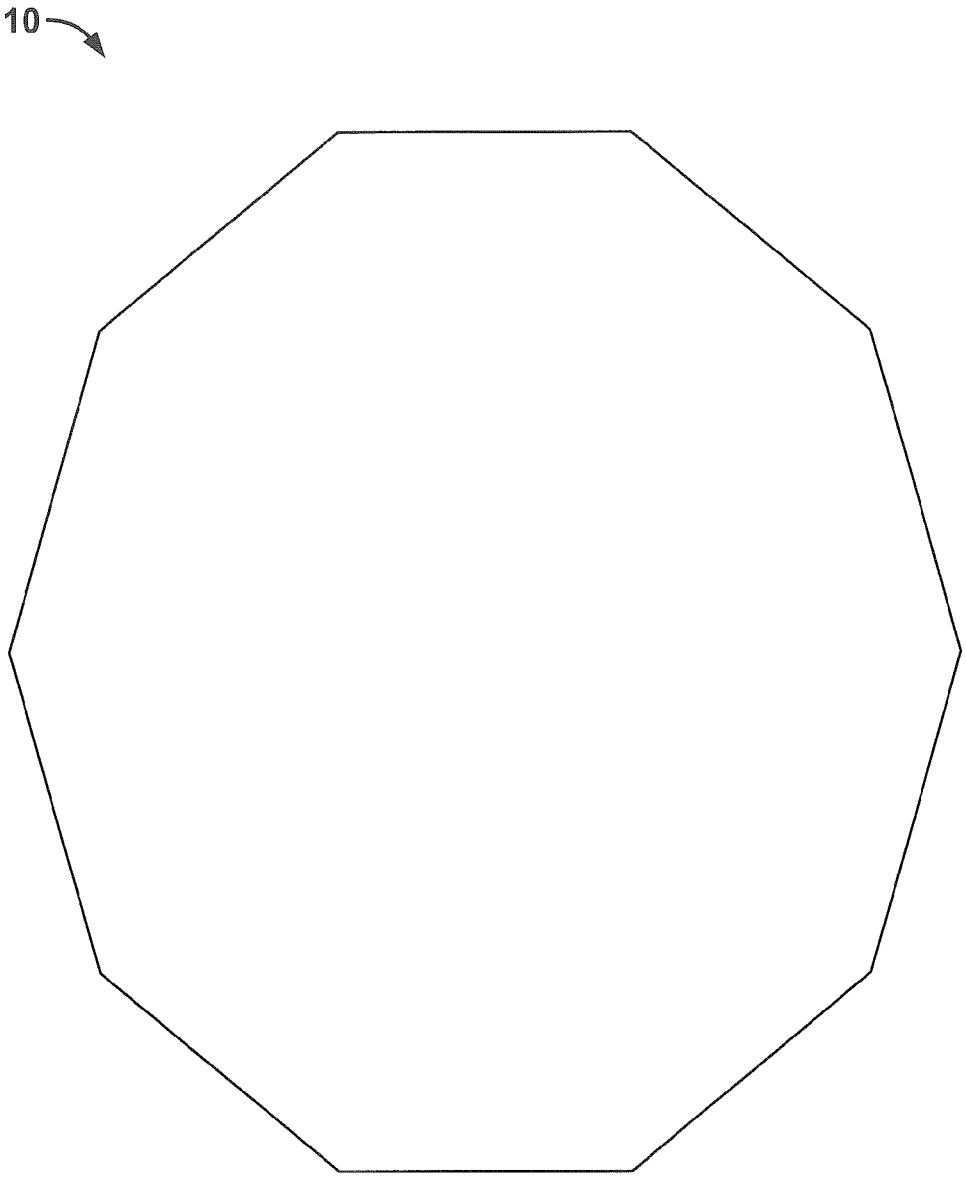
FIG. 1 is a top view of the decagonal shaped diamond of the present invention showing a symmetrical arrangement of ten main crown facets on the table facet side of the diamond.
Figure 2:
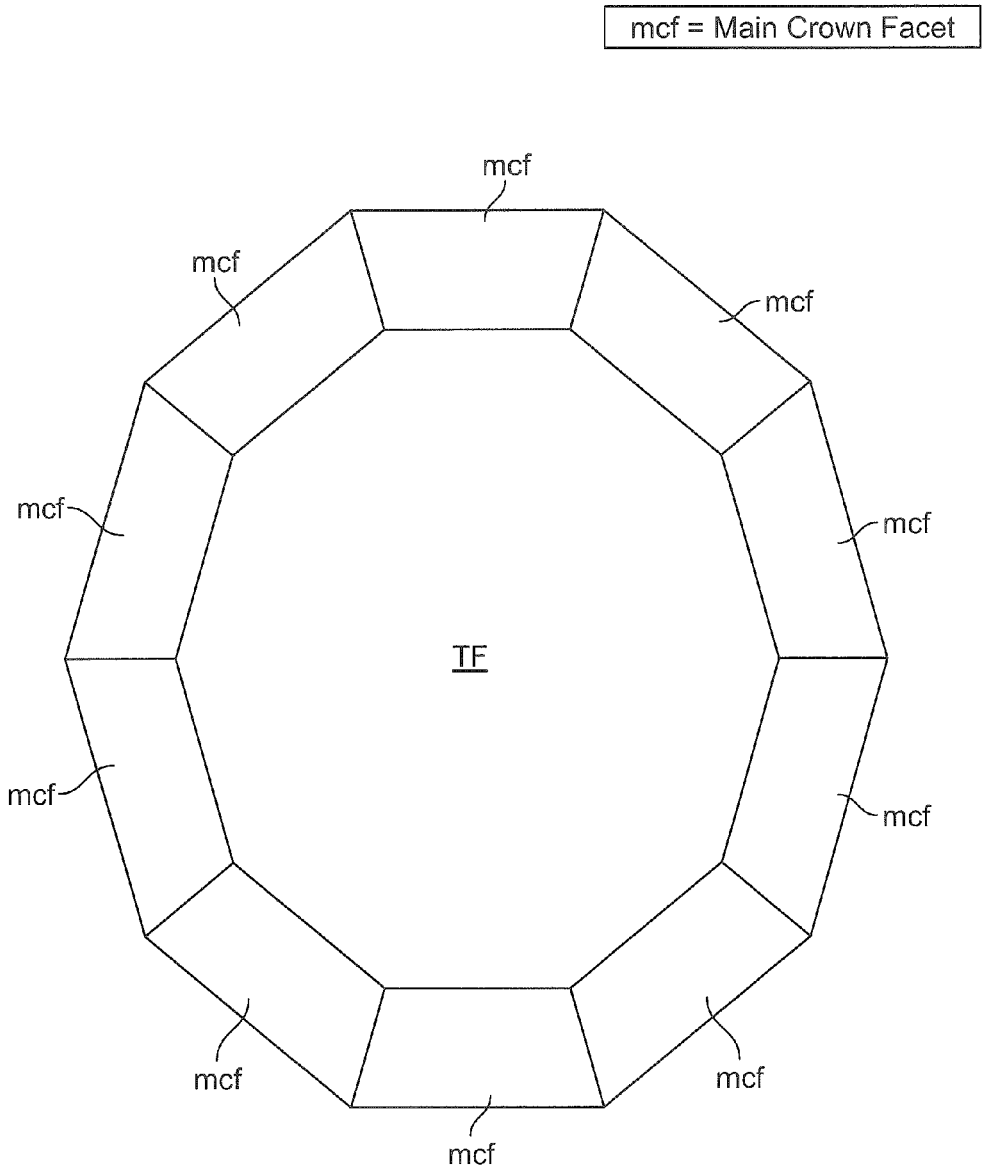
FIG. 2 is another top view of the decagonal shaped diamond of the present invention similar to FIG. 1 showing the formation and symmetrical arrangement of the main crown facets relative to one another.
Figure 3:
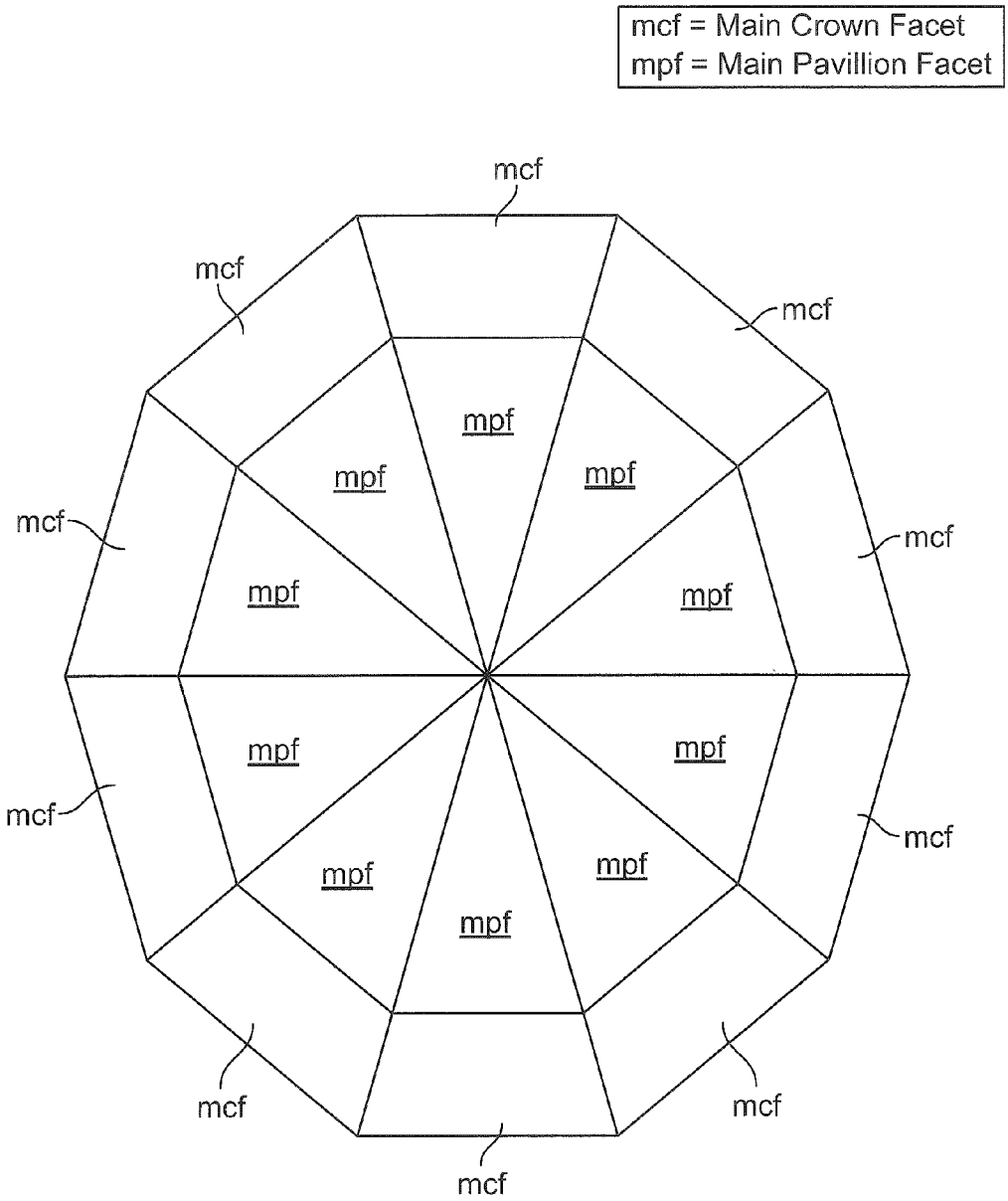
FIG. 3 is yet another top view of the decagonal shaped diamond of the present invention similar to FIG. 2 showing the formation and arrangement of the main crown facets and the counterpart main pavilion facets.
Figure 4:
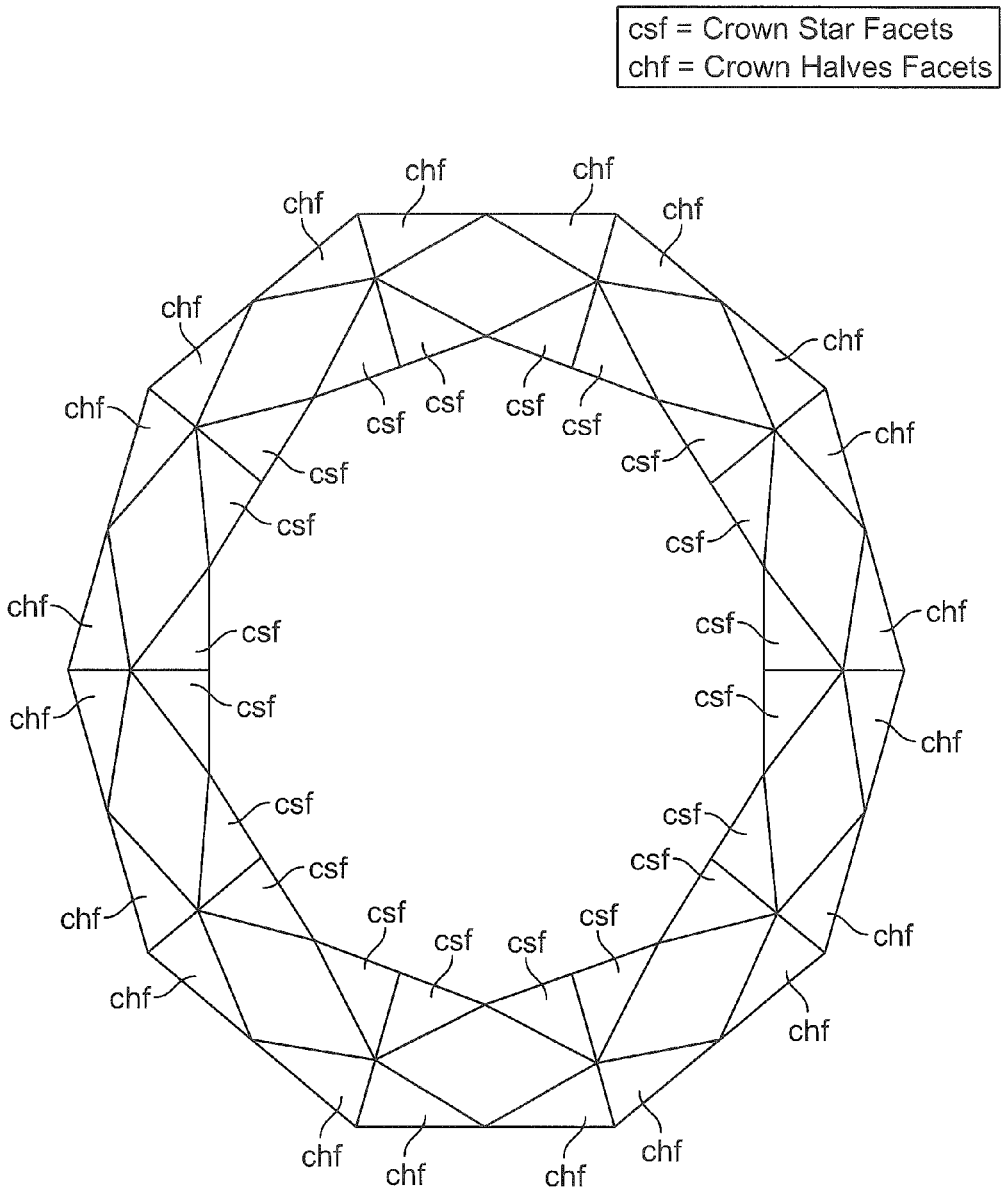
FIG. 4 is an additional top view of the decagonal shaped diamond of the present invention similar to FIG. 2 showing the arrangement and relationship of the crown star facets, crown half facets and the main crown facets.

A diamond is a crystal which functions as a prism for dispersing light by means of reflection and refraction. The diamond of the present invention 10, as shown in FIGS. 1-6, possesses a decagonal shape having ten main crown facets (mcf's) of essentially equal size with each main crown facet (mcf) being aligned opposite another main crown (mcf) facet in a symmetrical arrangement surrounding a table facet (tf) ten main pavilion facets (mpf's) each in alignment with a main crown facet, twenty crown star facets (csf's) of substantially equal size with two of the crown star facets polished on every main crown facet (mcf), a number of crown half facets (chf's) equal to the number of pavilion half facets (phf's) and preferably corresponding to the number of crown star facets (csf's), twenty subsidiary pavilion half facets (sphf's), ten subsidiary pavilion facets (spf's) and ten main girdle facets (gf's) with the girdle facets polished at a given angle relative to one another for forming the decagonal shape of the diamond.

The girdle facets gf's are polished first into ten equal size girdle facets gf's to give the diamond a decagonal shaped geometry and a slightly uneven girdle thickness with all of the main facets in line with the shape of the stone. Each girdle facet should be equal in size and at a precise angle of preferably 36° relative to each adjacent girdle facet. The main crown facets are then polished preferably within an angle range of 33.8° to 35.2° and should preferably be of equal size and depth. The main pavilion facets may then be polished in alignment to the main crown facets and main girdle facets and preferably within an angle degree range of 40.6° to 41.1°. The subsidiary pavilion facets are identical throughout and polished within an angle degree range of 48° to 67° and the subsidiary pavilion half facets are polished at an angle of between 2-3 degrees steeper than the subsidiary pavilion facets and therefore their angle range is from 50° to 70°.

The 20 crown star facets and the 20 crown half facets are then polished on the decagonal shaped diamond 10 followed by polishing the pavilion half facets. The pavilion half facets are preferably polished within an angle range of 41.5°-42.2°. The crown half facets are preferably polished within an angle range of 37°-40.8°. The 20 crown star facets should be polished so that there are two star facets provided on every main crown facet. It should be understood that polishing two star facets on every main crown facet results in an unusual star pattern needed to assure that an undistorted hearts and arrows pattern will be displayed. Moreover, the angle degree tolerance between all pavilion half facets and for all the crown half facets should not exceed 0.8°.

The faceting alignment should be as near perfect as possible preferably using a microscope with a lens of 100× magnification to determine accuracy.

To produce a decagonal shaped diamond possessing a true hearts and arrows pattern equivalent to the hearts and arrows pattern of the round cut, the diamond should be cut to satisfy the optimum parameters as set forth below in Table I:

TABLE I

| | |
|---|---|
| Total Depth: | 61.0%-74.5% |
| Table size | 53.0%-60.2% |
| Pavilion Depth | 41.2%-46.5% |
| Crown Height | 13.4%-16.8% |
| Crown angle | 33.8%-35.2% |
| Girdle thickness | 0.6%-7.5% |

Angle degree discrepancy between all main facets has to be less than 0.5° and between all star crown and half facets less than 0.7°. The main facets should all be perfectly equal in terms of the angle degree used and size and depth and at an angle tolerance of 0.4°.

Figure 5:
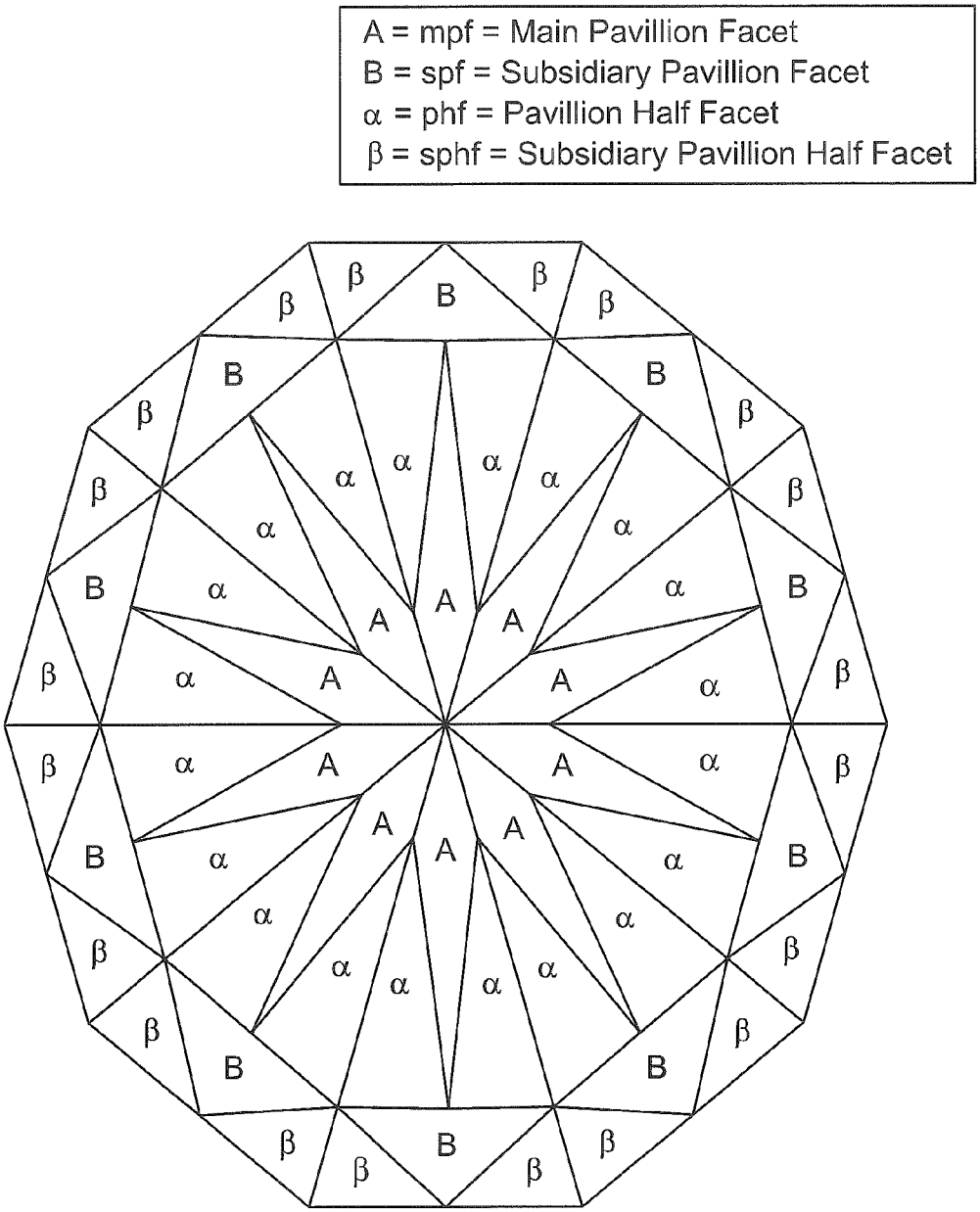
FIG. 5 is a bottom view of the decagonal shaped diamond of the present invention showing the arrangement between the ten main pavilion facets, the twenty pavilion half facets, the ten subsidiary pavilion half facets and the twenty subsidiary pavilion half facets symmetrically arranged about the center or culet of the diamond.
Figure 6:
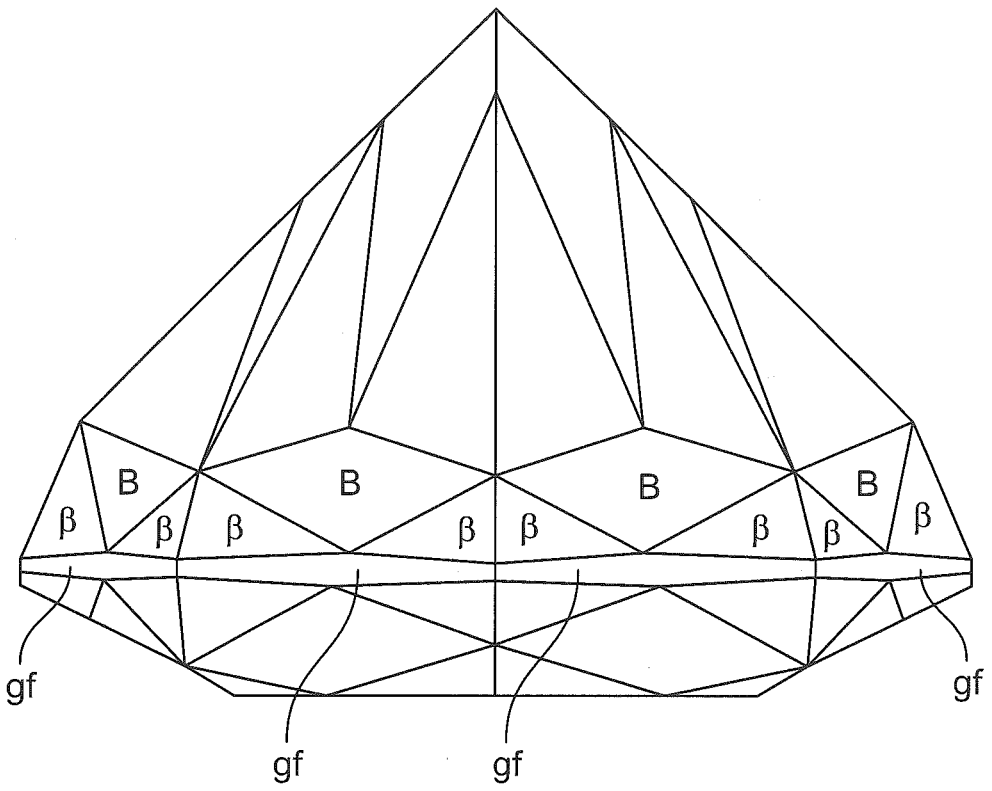
FIG. 6 is a side profile view of the decagonal shaped diamond of the present invention illustrating the subsidiary pavilion half facets and the subsidiary pavilion facets and showing a slightly uneven girdle thickness throughout the diamond.

The additional twenty subsidiary pavilion half facets (sphf's) and ten-subsidiary pavilion facets (spf's) enables the diamond to be fabricated to produce a higher polished yield from a raw diamond and is thereby less expensive to manufacture and more unique to the consumer. In FIGS. 5 and 6 the reference character "A" is being used to identify the main pavilion facets (mpf's), the reference character "B" to identify the subsidiary pavilion facets (spf's), the reference character "α" to identify the pavilion half facets (phf's) and the reference character "β" to identify the subsidiary pavilion half facets (sphf's). As shown in FIGS. 5 and 6 the main pavilion facets "A" and the pavilion half facets "α" extend to only the subsidiary pavilion facets with the main pavilion facets extending in common from the culet point of the diamond to a location intersecting each subsidiary pavilion facet and the twenty subsidiary pavilion half facets connected in pairs with each pair connected to one another along a common axis extending from a point equidistant from the culet point of the diamond.

What is claimed is:

1. A ten sided decagonal shaped diamond, adapted to display a hearts and arrows pattern when exposed to light comparable to the hearts and arrows pattern inherently displayed in a round diamond when cut perfectly symmetrically, comprising: ten main crown facets symmetrically arranged about a table facet, twenty star facets with two star facets polished on every main crown facet, ten main pavilion facets, twenty crown half facets and twenty pavilion half facets, twenty subsidiary pavilion half facets, ten subsidiary pavilion facets and ten main girdle facets, with the subsidiary pavilion facets lying between the subsidiary pavilion half facets and the main pavilion facets respectively such that the main pavilion facets extend from a common culet point of the diamond to only the subsidiary pavilion facets and with the girdle facets polished to provide a slightly uneven girdle thickness relative to one another with each girdle facet lying at a given angle relative to one another for forming the decagonal shape of the diamond and wherein the subsidiary pavilion facets are polished to within a degree range of between 48°-67° and that the subsidiary pavilion half facets are polished within a degree range of from 50° to 70°.

2. The decagonal shaped diamond as defined in claim 1 wherein the girdle facets are polished into ten equal size girdle facets forming an angle of 36° relative to the girdle facet on each adjacent side thereof.

3. The decagonal shaped diamond as defined in claim 1 wherein the main crown facets are polished to within a degree range of between 33.8°-35.2° and within an angle tolerance of 0.4°.

4. The decagonal shaped diamond as defined in claim 1 wherein the ten main pavilion facets are polished in alignment with the main crown facets and girdle facets at an angle degree range of between 40.6°-41.1°.

5. The decagonal shaped diamond as defined in claim 4 wherein the ten main pavilion facets extend from a common point located at the center or culet of the diamond.

6. The decagonal shaped diamond as defined in claim 5 further comprising twelve pavilion half facets of triangular geometry with two of the pavilion half facets formed on each main pavilion facet in a symmetrical arrangement.

7. The decagonal shaped diamond as defined in claim 6 wherein each pavilion half facet is polished to within an angle degree range of between 41.5° and 42.2° and angle degree range for the crown half facets should be between 37.0°-40.8°.

8. The decagonal shaped diamond as defined in claim 7 wherein the angle degree tolerance between the pavilion half facets and the crown half facets does not exceed 0.8°.

* * * * *